US012788159B2

(12) United States Patent
Kajan et al.

(10) Patent No.: US 12,788,159 B2
(45) Date of Patent: Nov. 10, 2026

(54) REFRIGERATED DISPLAY CASE SYSTEMS

(71) Applicant: Hill Phoenix, Inc., Conyers, GA (US)

(72) Inventors: Illya Kajan, Midlothian, VA (US); Edin Avdic, Henrico, VA (US); Jesse Comer, Henrico, VA (US); Hieu Nguyen, Chesterfield, VA (US)

(73) Assignee: Hill Phoenix, Inc., Conyers, GA (US)

( * ) Notice: Subject to any disclaimer, the term of this patent is extended or adjusted under 35 U.S.C. 154(b) by 279 days.

(21) Appl. No.: 18/345,932

(22) Filed: Jun. 30, 2023

(65) Prior Publication Data

US 2025/0000278 A1 Jan. 2, 2025

(51) Int. Cl.

| | |
|---|---|
| ***A47F 3/04*** | (2006.01) |
| ***F25B 9/00*** | (2006.01) |
| ***F25B 41/40*** | (2021.01) |

(52) U.S. Cl.

CPC ..... *A47F 3/0408* (2013.01); *F25B 9/002* (2013.01); *F25B 41/40* (2021.01)

(58) Field of Classification Search

CPC . F25D 23/006; F25D 2317/0665; F25B 9/002
USPC ..... 62/249
See application file for complete search history.

(56) References Cited

U.S. PATENT DOCUMENTS

| | | | | |
|---|---|---|---|---|
| 2,462,115 | A * | 2/1949 | Luecke | F25D 19/00 62/448 |
| 10,036,491 | B2 | 7/2018 | Harris et al. | |
| 10,502,472 | B2 | 12/2019 | Knatt | |
| 10,677,505 | B2 | 6/2020 | Knatt | |
| 11,231,218 | B2 | 1/2022 | Knatt | |
| 2003/0230104 | A1 * | 12/2003 | Morse | F25D 21/14 62/448 |
| 2015/0257549 | A1 * | 9/2015 | Shaprio | F25D 17/02 62/255 |

(Continued)

FOREIGN PATENT DOCUMENTS

| | | | |
|---|---|---|---|
| CN | 204941850 U | * | 1/2016 |
| JP | H0198874 A | * | 4/1989 |

(Continued)

OTHER PUBLICATIONS

Nishihata et al. (WO2012153518A1) English Translation (Year: 2012).*

(Continued)

*Primary Examiner* — Elizabeth J Martin
*Assistant Examiner* — Keona Lauren Banks
(74) *Attorney, Agent, or Firm* — Fish & Richardson P.C.

(57) ABSTRACT

A refrigerated display case system includes a display case that defines an inner volume and a closed-circuit refrigeration system. The closed-circuit refrigeration system includes a condensing unit configured to sit on a top surface of the display case and including a compressor and a condenser assembly; a cooling coil and a fan configured to circulate an airflow from the inner volume through the cooling coil to cool the airflow; a liquid line coupled to an inlet of the cooling coil and to the condensing unit; and a rigid suction line coupled to an outlet of the cooling coil and to the condensing unit. The rigid suction line includes at least two bends between the outlet and the condensing unit and is configured to circulate a vapor phase of the refrigerant from the cooling coil to the condensing unit.

25 Claims, 4 Drawing Sheets

(56) References Cited

U.S. PATENT DOCUMENTS

| | | | | |
|---|---|---|---|---|
| 2022/0087446 | A1* | 3/2022 | Friend | F25D 19/02 |
| 2022/0268504 | A1 | 8/2022 | Knatt | |
| 2022/0349641 | A1 | 11/2022 | Knatt | |
| 2023/0204277 | A1 | 6/2023 | Clay et al. | |

FOREIGN PATENT DOCUMENTS

| | | | | |
|---|---|---|---|---|
| WO | WO-2012153518 | A1 * | 11/2012 | F04B 49/02 |
| WO | WO 2021/111624 | | 6/2021 | |

OTHER PUBLICATIONS

Huang et al. (CN204941850U) English Translation (Year: 2016).*
Master-Bilt Refrigeration Solutions, Endless Glass Door Merchandisers Brochure, Jun. 15, 2023, [retrieved on Sep. 20, 2025]. Retrieved from Internet Archive < https://web.archive.org/web/20230615120958/https:/master-bilt.com/wp-content/uploads/2021/03/Endless-Merchandisers-Brochure.pdf> (Year: 2023).*
Aoki (JP-H0198874-A) English Translation (Year: 1989).*

* cited by examiner

REFRIGERATED DISPLAY CASE SYSTEMS

TECHNICAL FIELD

The present disclosure is directed to refrigerated display case systems and, more particularly, refrigerated display case systems that include a refrigerated display case and a closed-circuit vapor compression cycle refrigeration system coupled to the refrigerated display case.

BACKGROUND

Refrigerated display case systems, such as those that are used to store and keep certain perishable items (e.g., food, drinks) refrigerated or frozen, are often delivered and installed in self-contained units. Each self-contained refrigeration unit can include a display case to store the refrigerated items and a refrigeration system that operates to keep the items refrigerated or frozen. In some scenarios, the self-contained refrigeration unit needs to be moved through doorways or other openings that are limited in height or clearance.

SUMMARY

In an example implementation, a refrigerated display case system includes a display case that defines an inner volume configured to store one or more perishable items; and a closed-circuit refrigeration system. The closed-circuit refrigeration system includes a condensing unit configured to sit on a top surface of the display case and including at least one compressor and at least one condenser assembly; a cooling assembly that includes at least one cooling coil and at least one fan configured to circulate an airflow from the inner volume through the at least one cooling coil to cool the airflow with a liquid phase of a refrigerant supplied from the condensing unit; a liquid line coupled to an inlet of the at least one cooling coil and to the condensing unit; and a rigid suction line coupled to an outlet of the at least one cooling coil and to the condensing unit. The rigid suction line includes at least two bends between the outlet and the condensing unit and is configured to circulate a vapor phase of the refrigerant from the at least one cooling coil to the condensing unit. The at least one fan is further configured to circulate the cooled airflow to the inner volume to adjust or maintain a temperature of the inner volume. The liquid line is configured to circulate the liquid phase of the refrigerant from the condensing unit to the at least one cooling coil.

In an aspect combinable with the example implementation, the rigid suction line is copper.

In another aspect combinable with any of the previous aspects, the refrigerant is R290.

Another aspect combinable with any of the previous aspects further includes a critical charge of the R290.

In another aspect combinable with any of the previous aspects, the critical charge of the R290 is between 100 and 300 grams.

In another aspect combinable with any of the previous aspects, the display case has a height of less than 80 inches.

In another aspect combinable with any of the previous aspects, the condensing unit has a height of between about 11 and 18 inches.

In another aspect combinable with any of the previous aspects, the at least two bends include a first bend in a first plane of a first radius; and a second bend in the first plane of a second radius different than the first radius.

In another aspect combinable with any of the previous aspects, the first radius is between 3 and 6 inches, and the second radius is between 10 and 12 inches.

In another aspect combinable with any of the previous aspects, the liquid line includes a capillary tube.

Another aspect combinable with any of the previous aspects further includes a shelf configured to couple to the display case and support the condensing unit while the rigid suction line is coupled to the outlet of the at least one cooling coil and to the condensing unit.

In another aspect combinable with any of the previous aspects, the shelf is configured to support the condensing unit at a distance below the top surface of the display case.

In another example implementation, a method includes identifying a refrigerated display case system that includes a display case that defines an inner volume; and a closed-circuit refrigeration system. The closed-circuit refrigeration system includes a condensing unit supported on a top surface of the display case and including at least one compressor and at least one condenser assembly; a cooling assembly that includes at least one cooling coil and at least one fan configured to circulate an airflow from the inner volume through the at least one cooling coil to cool the airflow with a liquid phase of a refrigerant supplied from the condensing unit, where the at least one fan is further configured to circulate the cooled airflow to the inner volume to adjust or maintain a temperature of the inner volume; a liquid line coupled to an inlet of the at least one cooling coil and to the condensing unit, where the liquid line is configured to circulate the liquid phase of the refrigerant from the condensing unit to the at least one cooling coil; and a rigid suction line coupled to an outlet of the at least one cooling coil and to the condensing unit, where the rigid suction line includes at least two bends between the outlet and the condensing unit and configured to circulate a vapor phase of the refrigerant from the at least one cooling coil to the condensing unit. The method includes moving the condensing unit from the top surface of the display case to a location at or below the top surface, the moving including bending the at least two bends without disconnecting the rigid suction line from the at least one cooling coil or the condensing unit.

In an aspect combinable with the example implementation, moving the condensing unit includes moving the condensing unit to a shelf coupled to the display case so that the condensing unit is a distance below the top surface of the display case.

Another aspect combinable with any of the previous aspects further includes, subsequent to moving the condensing unit from the top surface of the display case to the location at or below the top surface, moving the refrigerated display case system through an opening.

In another aspect combinable with any of the previous aspects, the opening has a dimension greater than a dimension of the display case and less than a sum of the dimension of the display case and a dimension of the condensing unit.

In another aspect combinable with any of the previous aspects, the dimension of the display case is less than 80 inches, and the dimension of the condensing unit is between about 11 and 18 inches.

Another aspect combinable with any of the previous aspects further includes, subsequent to moving the refrigerated display case system through the opening, moving the condensing unit from the location at or below the top surface back to the top surface of the display case.

In another aspect combinable with any of the previous aspects, moving the condensing unit from the location at or below the top surface back to the top surface of the display case includes bending the at least two bends without disconnecting the rigid suction line from the at least one cooling coil or the condensing unit.

Another aspect combinable with any of the previous aspects further includes, subsequent to moving the condensing unit from the location at or below the top surface back to the top surface of the display case, operating the closed-circuit refrigeration system to maintain the temperature of the inner volume.

In another aspect combinable with any of the previous aspects, the rigid suction line is copper.

In another aspect combinable with any of the previous aspects, the refrigerant is 290.

In another aspect combinable with any of the previous aspects, the closed-circuit refrigeration system includes a critical charge of the R290.

In another aspect combinable with any of the previous aspects, the critical charge of the R290 is between 100 and 300 grams.

In another aspect combinable with any of the previous aspects, the at least two bends include a first bend in a first plane of a first radius; and a second bend in the first plane of a second radius different than the first radius.

In another aspect combinable with any of the previous aspects, the first radius is between 3 and 6 inches, and the second radius is between 10 and 12 inches.

Implementations according to the present disclosure may include one or more of the following features. For example, implementations of a refrigerated display case system according to the present disclosure can provide for movement of the refrigerated display case system that includes a critically charged condensing unit through a restricted opening while keeping suction and liquid lines connected within a closed-circuit refrigeration system and without kinking by moving the condensing unit from a top of the case to another location. As another example, implementations of a refrigerated display case system according to the present disclosure can pass through an 80 inch door frame without disassembly by shifting the condensing unit from the top of the case to the other location. As another example, implementations of a refrigerated display case system according to the present disclosure can be shipped and arrive pre-charged (with refrigerant), with a closed-circuit refrigeration cycle being fully connected. Thus, implementations of a refrigerated display case system according to the present disclosure can simplify an installation process compared to refrigerated display case systems that use quick connects, thereby providing a decrease in installation time to benefit an end user of the system.

The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

The present disclosure describes systems and methods for refrigerated display cases, including refrigerated display case systems that include a refrigerated display case and a closed-circuit refrigeration system that operates to maintain a temperature of the display case to store perishable items therein. Example implementations of a refrigerated display case system include a moveable condensing unit that, during regular or normal operation of the refrigeration system, sits on top of the display case. However, during movement of the display case, such as through a size-restricted opening such as a door that is only minimally larger than the display case, the condensing unit is movable to a location below the top of the display case without being disconnected, e.g., with the suction and liquid lines being connected to a cooling assembly of the refrigeration system.

In some aspects, example implementations of refrigerated display case systems according to the present disclosure utilize propane (i.e., R290) as the refrigerant in the closed-circuit refrigeration system. In some aspects, such as due to the flammability of propane, a total amount (e.g., in grams) of propane within the closed-circuit refrigeration system cannot exceed a particular amount. For example, depending on the size of the display case, the total amount can be limited to 150 grams of propane refrigerant charge. Other examples of refrigerated display case system 100 can include a charge of less than 300 grams of R290 (e.g., for some closed display cases) or less than 500 grams or R290 (e.g., for some open display cases). However, should the closed-circuit refrigeration system have less than the maximum charge, such as due to leaks in the suction and/or liquid lines, then the cooling efficiency and performance of the system can degrade. Other refrigerants, such as carbon dioxide, HFCs, blends such as A2L refrigerants, can also be used in the closed-circuit refrigeration system of the refrigerated display case system 100.

Thus, in some aspects, the system may perform best with a critical charge of propane (or other type of) refrigerant, with the critical charge being an amount of refrigerant that does not exceed a maximum amount, but which is sufficient to allow the closed-circuit refrigerant system to meet its published or nominal cooling performance standards. In some aspects, utilizing a rigid suction line, such as copper tubing with brazed connections (or other hard tubing such as aluminum), can help eliminate refrigerant leaks in the closed-circuit refrigeration system.

Figure 1A:
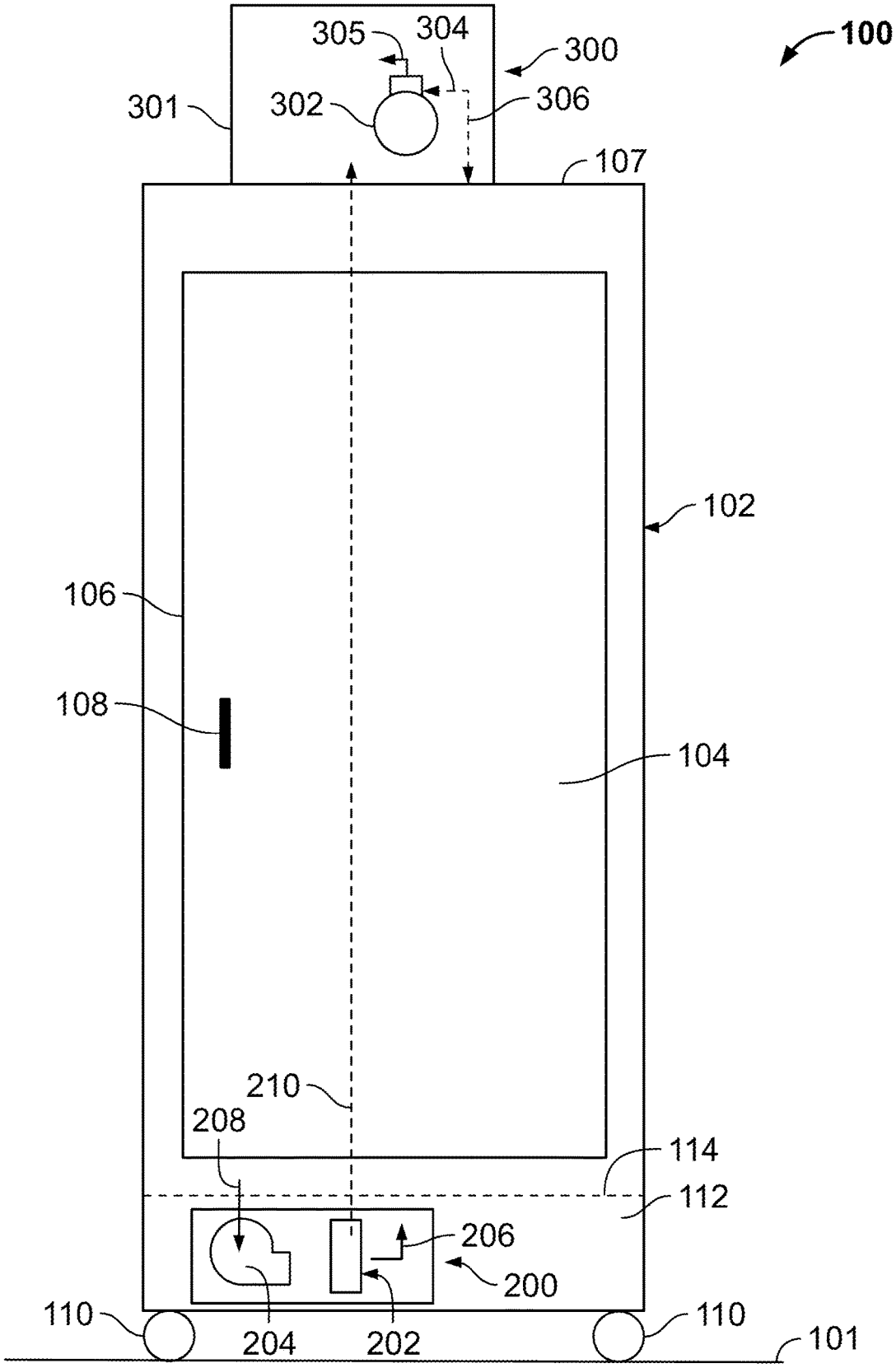
FIGS. 1A and 1B are schematic drawings of front and rear views, respectively, of an example implementation of a refrigerated display case system according to the present disclosure.
Figure 1B:
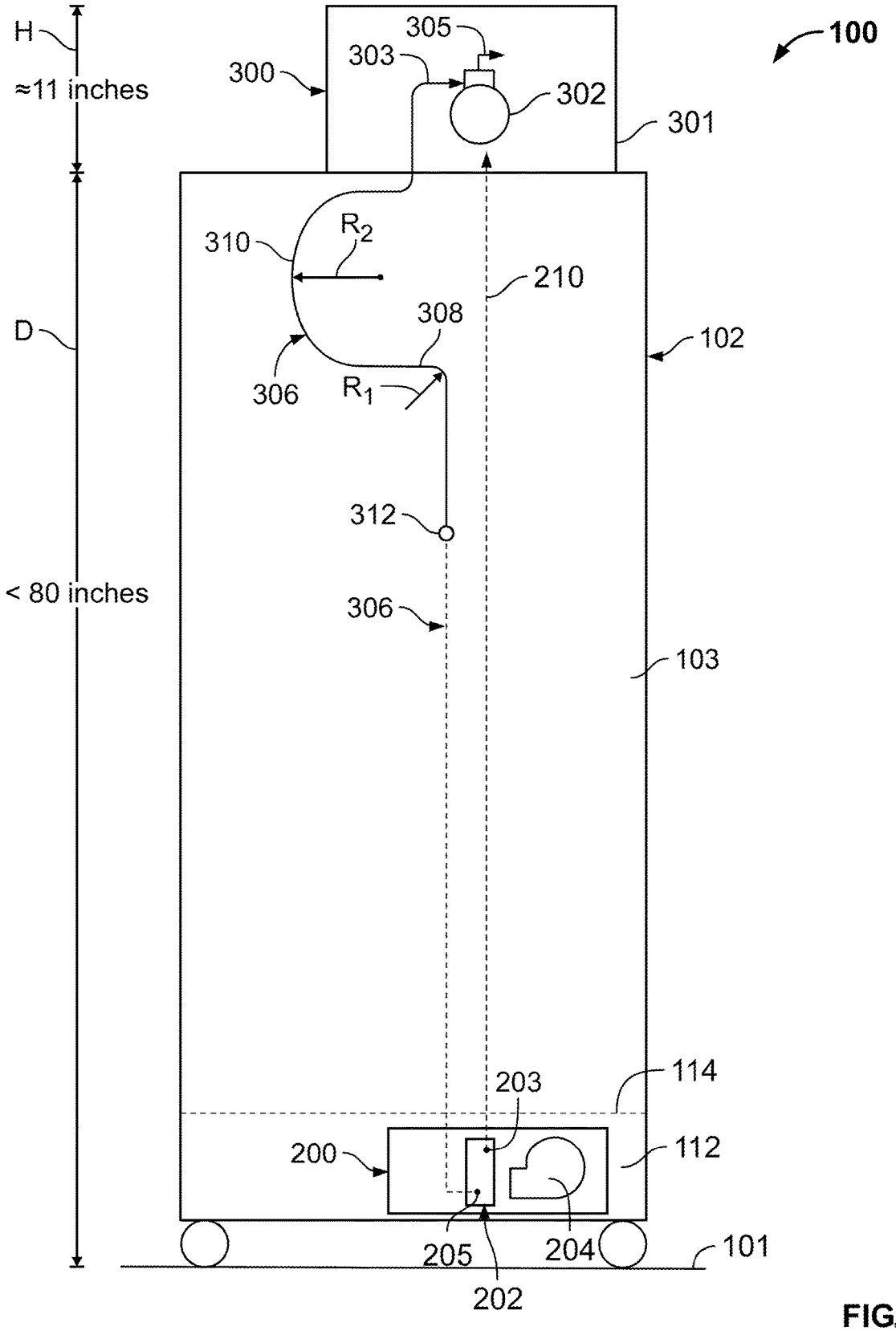

FIGS. 1A and 1B are schematic drawings of front and rear views, respectively, of an example implementation of a refrigerated display case system 100 according to the present disclosure. In this example, the refrigerated display case system 100 includes a display case 102 that encloses an inner volume 104 into which perishable items (such as food or drinks) can be stored and maintained at a particular refrigerated (or freezing) temperature. In this example, the display case 102 includes at least one access door 106, and even up to six access doors 106 (with handle 108), that allows access into the inner volume 104. Other implementations of the display case 102 may not include the door 106 but may instead have an opening that allows access to the inner volume 104 from an external environment (such as a human-occupiable building of a convenience or grocery store).

In this example, optional wheels 110 are coupled to the display case 102 and are part of the display case 102 to allow movement of the refrigerated display case system 100 along a support surface 101, such as a floor. In other examples, however, the wheels 110 may be removed or optional and the display case 102 can rest on the support surface 101.

In the example implementation of FIGS. 1A and 1B, the refrigerated display case system 100 includes a closed-circuit refrigeration system that is comprised of a condensing unit 300 (shown in these figures as positioned on a top surface 107 of the display case 102) and a cooling assembly 200. Cooling assembly 200, in this example, is positioned in a plenum 112 that is separated from inner volume 104 by panel 114 (such as a perforated panel). Cooling assembly 200 includes, generally, at least one cooling coil 202 and at least one fan 204. During operation of the closed-circuit refrigeration system, relatively warm return airflow 208 is circulated by fan 204 from the inner volume 104 to (and through) cooling coil 202, where it is cooled by liquid refrigerant supplied to the cooling coil 202 through liquid line 210. In some aspects, the liquid line 210 is a capillary tube or other semi-flexible conduit. Relatively cold supply airflow 206 is supplied to inner volume 104 to maintain a particular temperature within inner volume 104.

Figure 3:
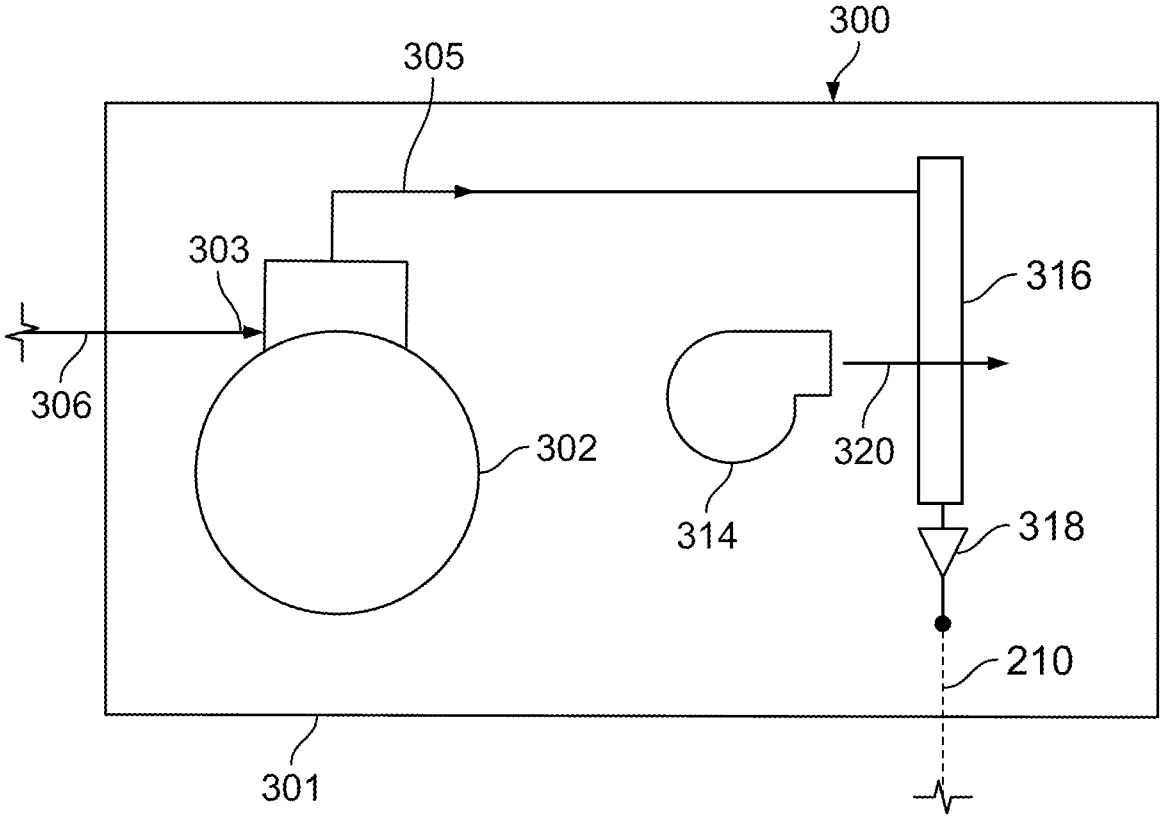
FIG. 3 is a schematic drawing of a condensing unit of a refrigerated display case system according to the present disclosure.

Condensing unit 300, in this example, includes a housing 301 that encloses at least one compressor 302 with a suction 304 and a discharge 305. Suction 304 is connected (e.g., brazed or otherwise) to a rigid suction line 306 (described in more detail herein). Turning briefly to FIG. 3, other components of the condensing unit 300 are shown. Compressor 302 is fluidly coupled through discharge 305 to supply a compressed refrigerant vapor to at least one condenser coil 316. At least one fan (or pump) 314 supplies a cooling fluid (air or liquid) 320 to the condenser coil 316 to condense the compressed refrigerant vapor to refrigerant liquid.

An expansion valve 318 (which can be positioned in the cooling assembly 200) is fluidly coupled to the condenser coil 316 to receive the liquid refrigerant (at a high pressure) and expand the refrigerant liquid to a low pressure (colder) refrigerant liquid that is supplied to the cooling assembly 200 through liquid line 210. Expansion valve 318 can be, for example, a thermal expansion valve. In some aspects when the liquid line 210 is a capillary tube, the capillary tube can act as the metering/expansion device in the closed-circuit refrigeration system, thereby removing the expansion valve 318.

Turning now to FIG. 1B, a rear view of the refrigerated display case system 100 is presented, showing an example implementation of the rigid suction line 306. As shown in this figure, the rigid suction line 306 is coupled to the cooling coil 202 at outlet 205 and to the suction 303 of the compressor 302. Liquid line 210 is coupled to inlet 203 of the cooling coil 202 and to the condensing unit 300 (at the expansion valve 318).

FIG. 1B shows the refrigerated display case system 100, e.g., in a normal operation mode when the condensing unit 300 is positioned on the top surface 107 of the display case 102 and the refrigerated display case system 100 is a self-contained unit (i.e., a display case and integrated refrigeration system). As shown, the display case 102 is defined by a particular dimension (e.g., height), D. D, in some aspects, can be slightly (e.g., between 0.5-2 inches) less than 80 inches in order to fit through certain openings, such as 80 inch tall doors. The condensing unit 300 is defined by another particular dimension (e.g., height), H, which can be about 11 inches (but can be in a range of between 11 and 18 inches tall). Thus, a total height of the display case 102 and condensing unit 300 (on top of the display case 102) can be about 90 inches or even up to 100 inches tall (i.e., taller than a standard 80 inch door).

As shown in FIG. 1B, the rigid suction line 306 extends down (and in part through) a back panel 103 of the display case 102. For example, the rigid suction line 30 can include a portion (shown in dashed line) that goes through the back panel 103 at an aperture 312 and extends within the display case 102 to connect (e.g., by brazing) to the outlet 205 of the cooling coil 202.

In some aspects, another portion of the rigid suction line 306 extends toward the condensing unit 300 from the aperture 312 external to the display case 102 (e.g., along the back panel 103). As shown in FIG. 1B, the rigid suction line 306 includes at least two bends prior to connecting to the compressor 302 at suction 303. For example, a first bend 308 in the rigid suction line 306 turns the rigid suction line 306 within a particular plane (e.g., a plane parallel to the back panel 103). The first bend 308 is defined by a first radius, R1, which can be, for example, between 3 and 6 inches. A second bend 310 in the rigid suction line 306 turns the rigid suction line 306 within the same plane (e.g., the plane parallel to the back panel 103). The second bend 310 is defined by a second radius, R2, which can be, for example, between 10 and 12 inches. Other bends in the rigid suction line 306, such as between second bend 310 and the suction 303, can also be formed in the rigid suction line 306.

Figure 2:
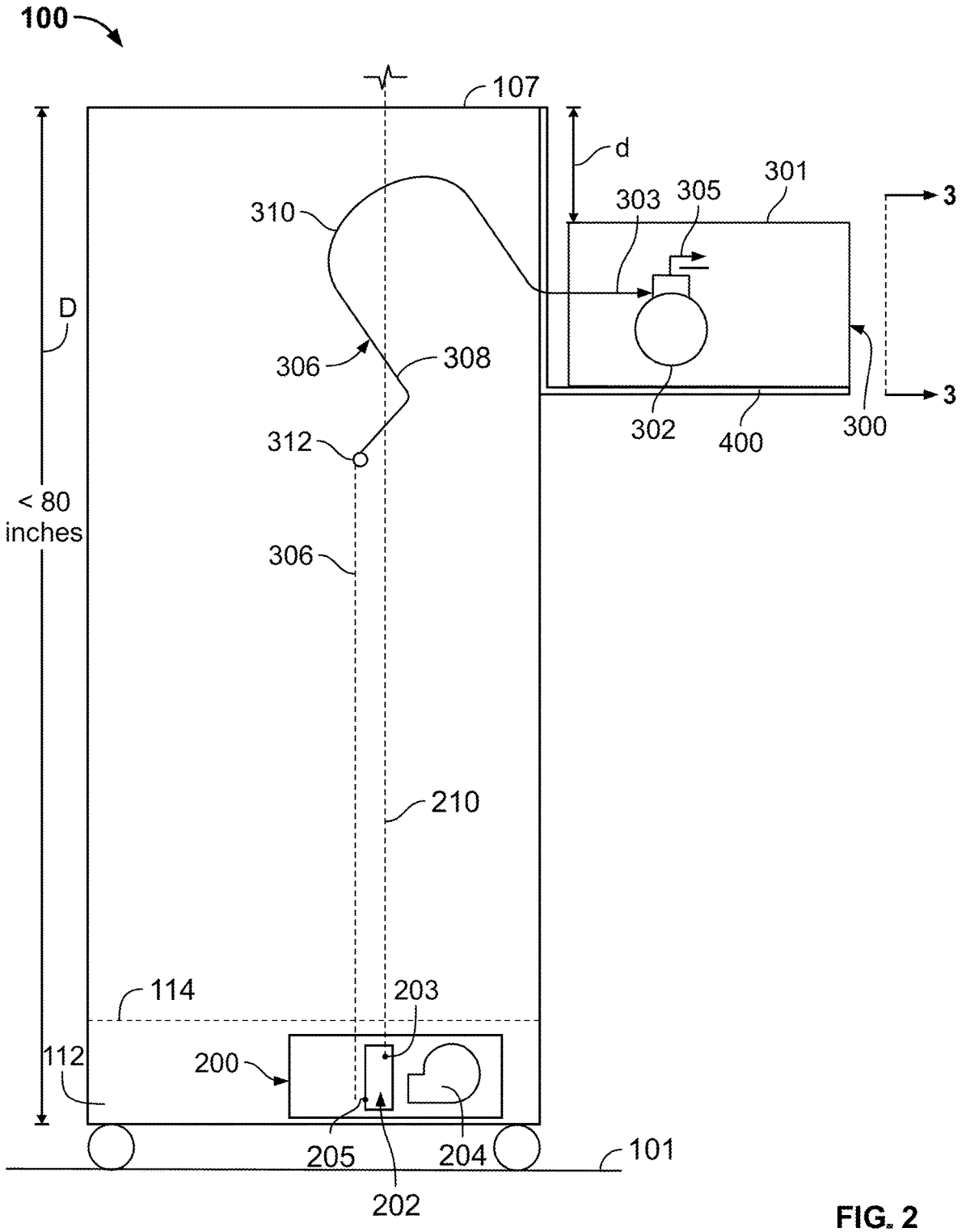
FIG. 2 is a schematic drawing of another rear view of the example implementation of the refrigerated display case system of FIGS. 1A and 1B with a location of a condensing unit moved to allow for movement of the refrigerated display case system through a height restricted opening according to the present disclosure.

FIG. 2 is a schematic drawing of another rear view of the example implementation of the refrigerated display case system 100 of FIGS. 1A and 1B with a location of the condensing unit 300 moved to allow for movement of the refrigerated display case system 100 through a height restricted opening according to the present disclosure. Generally, condensing unit 300 can be moved from the top surface 107 to a location even with or lower than the top surface 107 to allow for movement of the refrigerated display case system 100 through, e.g., an 80 inch tall doorway while the closed-circuit refrigeration system remains connected. Thus, the rigid suction line 306 and liquid line 210 remain connected to the cooling assembly 200 and condensing unit 300 during movement of the condensing unit 300 to the lower location and during movement of the refrigerated display case system 100 through the door (or other height restricted opening). For instance, the rigid suction line 306 remains connected to outlet 205 of the cooling coil 202 (at one end) and the suction 303 (at the other end). The liquid line 210 remains connected to the inlet 203 of the cooling coil 202 (at one end) and the condenser coil 316 (at another end).

In example implementations, a shelf 400 can be installed (e.g., hung) on the display case 100 to provide a location to support the condensing unit 300 during movement of the refrigerated display case system 100. As shown in this example, when supported on the shelf 400, the condensing unit 300 can be a distance, d, lower (or even with) the top surface 107 of the display case 100. The distance, d, can be, for example, 0 inches or greater; thus, the condensing unit 300 can be even with or lower than the top surface 107 while on the shelf 400. In some aspects, the condensing unit 300 could be higher than the top surface 107 as long as the refrigerated display case system 100 is able to move through a restricted height opening (such as an 80 inch tall door).

As noted, movement of the condensing unit 300 occurs while the closed-circuit refrigeration system remains connected, e.g., while the rigid suction line 306 remains connected between the condensing unit 300 and cooling assembly 200. Advantageously, the refrigerant critical charge remains within the closed-circuit refrigeration system while the condensing unit 300 is moved (and while the refrigerated display case system 100 is moved). In some aspects, the connection of the rigid suction line 306 can remain due at least in part on the bends 308 and 310 in the rigid suction line 306 (which, in some aspects, is a rigid copper tubing of sufficient thickness to meet the pressure requirements of the working refrigerant). As shown in FIG. 2, the bends 308 and 310 allow for sufficient flexure of the rigid suction line 306 to remain connected (and without breaking to cause refrigerant leaks) while the condensing unit 300 is moved from the top surface 107 to the shelf 400.

With reference to FIGS. 1B and 2, an example operation that involves the refrigerated display case system 100 can include the following steps. Initially, the refrigerated display case system 100 can be delivered to a particular location (convenience store, grocery store, multi-purpose store) as a self-contained unit with a critical charge of refrigerant already enclosed within the closed-circuit refrigeration system. In the case of the refrigerated display case system 100 needing to be initially installed in a facility and moved through a restricted height opening, such as an 80 inch tall doorway, the condensing unit 300 can be moved, e.g., to shelf 400 that can be separately supplied with the refrigerated display case system 100. In some aspects, the shelf 400 is designed to hang on the display case 102, such as the top surface 107. Once installed, the condensing unit 300 is moved to the shelf 400 such that a top of the condensing unit 300 is at or below the top surface 107. During movement, the rigid suction line 306 and liquid line 210 remain connected and flex sufficiently to allow movement of the condensing unit 300 without breaking. In particular, rigid suction line 306 can flex (e.g., bend) at the bends 308 and 310 to remain connected. Liquid line 210, in the case of a capillary tube, can flex sufficiently without the need of bends.

Once the condensing unit 300 is moved, e.g., to the shelf 400, the refrigerated display case system 100 can be moved through the restricted height opening while remaining a self-contained unit (e.g., without any further disassembly). When the refrigerated display case system 100 arrives at its final (or operating) location, the condensing unit 300 can be moved back to the top surface 107 and the shelf 400 can be removed. As with the initial movement, movement of the condensing unit 300 to the top surface 107 occurs while the rigid suction line 306 and liquid line 210 remain connected and flex (e.g., bend) sufficiently to allow movement of the condensing unit 300 without breaking. The refrigerated display case system 100 can then be provided with electrical power and operate. Operation of the refrigerated display case system 100 includes operation of the closed-circuit refrigeration system (i.e., the condensing unit 300 and cooling assembly 200) to provide a cooling airflow to the inner volume 104 of the display case 102 to remain at a particular or desired refrigerated (or freezing) temperature.

This example operation can be repeated should the refrigerated display case system 100 need to move from one location to another location while passing through a restricted height opening subsequent to the initial installation.

While this specification contains many specific implementation details, these should not be construed as limitations on the scope of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described may include more steps or fewer steps than those described. Further, the steps in such example operations, methods, or processes may be performed in different successions than that described or illustrated in the figures. As another example, various components of a refrigerated display case system according to the present disclosure, such as thermostats or other controls, check valves, shut off valves, or other piping appurtenances are not shown for simplicity. Accordingly, other implementations are within the scope of the following claims.

What is claimed is:

1. A refrigerated display case system, comprising:

a display case that defines an inner volume configured to store one or more perishable items; and a closed-circuit refrigeration system, comprising:

a condensing unit configured to sit on a top surface of the display case and comprising at least one compressor and at least one condenser assembly;

a cooling assembly that comprises at least one cooling coil and at least one fan positioned in a bottom portion of the display case opposite the top surface of the display case and configured to circulate an airflow from the inner volume through the at least one cooling coil to cool the airflow with a liquid phase of a refrigerant supplied from the condensing unit, the at least one fan further configured to circulate the cooled airflow to the inner volume to adjust or maintain a temperature of the inner volume;

a liquid line coupled to an inlet of the at least one cooling coil and to the condensing unit, the liquid line configured to circulate the liquid phase of the refrigerant from the condensing unit to the at least one cooling coil; and a rigid suction line coupled to an outlet of the at least one cooling coil and to the condensing unit and extending between the cooling assembly and the condensing unit external to the display case and exposed to an external environment of a human-occupiable building, the rigid suction line comprising at least two bends between the outlet and the condensing unit, positioned in a plane parallel to a back panel of the display case, and configured to circulate a vapor phase of the refrigerant from the at least one cooling coil to the condensing unit, each of the at least two bends of the rigid suction line configured to flex to maintain a connection of the rigid suction line to the outlet of the at least one cooling coil and to the condensing unit in response to movement of the condensing unit from the top surface of the display case.

2. The refrigerated display case system of claim 1, wherein the rigid suction line is copper.

3. The refrigerated display case system of claim 1, wherein the refrigerant is R290.

4. The refrigerated display case system of claim 3, comprising a critical charge of the R290.

5. The refrigerated display case system of claim 4, wherein the critical charge of the R290 is between 100 and 300 grams.

6. The refrigerated display case system of claim 1, wherein the display case has a height of less than 80 inches.

7. The refrigerated display case system of claim 6, wherein the condensing unit has a height between 11 and 18 inches.

8. The refrigerated display case system of claim 1, wherein the at least two bends comprise:

a first bend in a first plane of a first radius; and a second bend in the first plane of a second radius different than the first radius.

9. The refrigerated display case system of claim 8, wherein the first radius is between 3 and 6 inches, and the second radius is between 10 and 12 inches.

10. The refrigerated display case system of claim 1, wherein the liquid line comprises a capillary tube.

11. The refrigerated display case system of claim 1, comprising a shelf configured to couple to the display case and support the condensing unit while the rigid suction line is coupled to the outlet of the at least one cooling coil and to the condensing unit.

12. The refrigerated display case system of claim 11, wherein the shelf is configured to support the condensing unit at a distance below the top surface of the display case.

13. A refrigerated display case system, comprising:

a display case that defines an inner volume configured to store one or more perishable items; and a closed-circuit refrigeration system, comprising:

a condensing unit configured to sit on a top surface of the display case and comprising at least one compressor and at least one condenser assembly;

a cooling assembly mounted in a plenum at a bottom end of the display case opposite the top surface and separated from the inner volume by a perforated panel, the cooling assembly comprising at least one cooling coil and at least one fan configured to circulate an airflow from the inner volume through the at least one cooling coil to cool the airflow with a liquid phase of propane refrigerant supplied from the condensing unit, the at least one fan further configured to circulate the cooled airflow to the inner volume to adjust or maintain a temperature of the inner volume;

a liquid line coupled to an inlet of the at least one cooling coil and to the condensing unit, the liquid line configured to circulate the liquid phase of the propane refrigerant from the condensing unit to the at least one cooling coil; and a copper suction line coupled to an outlet of the at least one cooling coil and to the condensing unit and coupled between the cooling assembly and the condensing unit external to the display case, the copper suction line comprising at least two radiused bends between the outlet and the condensing unit and configured to circulate a vapor phase of the propane refrigerant from the at least one cooling coil to the condensing unit, each the at least two radiused bends positioned in a plane parallel to a back panel of the display case and external to the display case.

14. The refrigerated display case system of claim 13, comprising a critical charge of the propane refrigerant.

15. The refrigerated display case system of claim 14, wherein the critical charge of the propane refrigerant is 300 grams.

16. The refrigerated display case system of claim 13, wherein the display case has a height of less than 80 inches.

17. The refrigerated display case system of claim 16, wherein the condensing unit has a height of between 11 and 18 inches.

18. The refrigerated display case system of claim 13, wherein the at least two bends comprise:

a first bend of a first radius; and a second bend of a second radius different than the first radius.

19. The refrigerated display case system of claim 18, wherein the first radius is between 3 and 6 inches, and the second radius is between 10 and 12 inches.

20. The refrigerated display case system of claim 13, wherein the liquid line comprises a capillary tube.

21. The refrigerated display case system of claim 13, comprising a shelf configured to couple to the display case and support the condensing unit while the copper line is coupled to the outlet of the at least one cooling coil and to the condensing unit.

22. The refrigerated display case system of claim 21, wherein the shelf is configured to support the condensing unit at a distance below the top surface of the display case.

23. The refrigerated display case system of claim 14, wherein the critical charge of the propane refrigerant is 150 grams.

24. The refrigerated display case system of claim 13, wherein the at least two bends comprise:

a first bend of a first radius;

a second bend of a second radius different than the first radius; and a third bend between the second bend and a suction of the at least one compressor.

25. The refrigerated display case system of claim 13, wherein each of at least two bends of the copper suction line is configured to flex to maintain a connection of the copper suction line to the outlet of the at least one cooling coil and to the condensing unit in response to movement of the condensing unit from the top surface of the display case.

* * * * *